US008746857B2

(12) United States Patent
Kawakubo et al.

(10) Patent No.: US 8,746,857 B2
(45) Date of Patent: Jun. 10, 2014

(54) INKJET RECORDING HEAD

(71) Applicants: Takashi Kawakubo, Kanagawa (JP); Kazuhiko Itaya, Kanagawa (JP); Chiaki Tanuma, Tokyo (JP)

(72) Inventors: Takashi Kawakubo, Kanagawa (JP); Kazuhiko Itaya, Kanagawa (JP); Chiaki Tanuma, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/650,797

(22) Filed: Oct. 12, 2012

(65) Prior Publication Data

US 2013/0100211 A1 Apr. 25, 2013

(30) Foreign Application Priority Data

Oct. 14, 2011 (JP) ..... 2011-226449

(51) Int. Cl.
*B41J 2/015* (2006.01)

(52) U.S. Cl.
USPC ..... 347/68

(58) Field of Classification Search
None
See application file for complete search history.

(56) References Cited

U.S. PATENT DOCUMENTS

| | | | | |
|---|---|---|---|---|
| 8,029,111 | B2 * | 10/2011 | Matsuo et al. | 347/71 |
| 2010/0013894 | A1 * | 1/2010 | Ueno et al. | 347/72 |
| 2010/0265301 | A1 * | 10/2010 | Takakuwa | 347/71 |

FOREIGN PATENT DOCUMENTS

| | | |
|---|---|---|
| JP | 11-291495 | 10/1999 |

* cited by examiner

*Primary Examiner* — Matthew Luu
*Assistant Examiner* — Erica Lin
(74) *Attorney, Agent, or Firm* — Patterson & Sheridan, L.L.P.

(57) ABSTRACT

An inkjet recording head of an embodiment includes: an elastic film provided to form a part of a pressure-generating chamber connected to a nozzle opening; and a piezoelectric film-laminated part, an end thereof being fixed to the elastic film, a central part thereof facing the elastic film having an air gap in-between, the piezoelectric film-laminated part including a lower electrode, a piezoelectric film, and an upper electrode.

7 Claims, 12 Drawing Sheets

INKJET RECORDING HEAD

CROSS-REFERENCE TO RELATED APPLICATION

This application is based upon and claims the benefit of priority from Japanese Patent Application No. 2011-226449, filed on Oct. 14, 2011, the entire contents of which are incorporated herein by reference.

FIELD

Embodiments described herein relate generally to an inkjet recording head.

BACKGROUND

As one structure of an inkjet recording head, a part of a pressure-generating chamber is formed of an elastic film, the pressure-generating chamber being connected to a nozzle opening for ejecting ink droplets, and an ink in the pressure-generating chamber is pressurized by the deformation of the elastic film by a piezoelectric film to eject the ink droplets from the nozzle opening. The inkjet recording head of this structure has been put into practical use while including a piezoelectric unimorph vibrator in a deflection vibration mode.

In the inkjet recording head of the above structure, a piezoelectric material layer is uniformly formed across the entire surface of the elastic film by a film-forming technology, and the piezoelectric vibrator is formed such that the piezoelectric material layer is cut into a form corresponding to the pressure-generating chamber by a lithography method and separated into each pressure-generating chamber. There is an advantage that not only can the piezoelectric vibrator be set up by the lithography method that is accurate and simple, but also the piezoelectric vibrator can be made thin, enabling it to be driven at a high speed. In this case, moreover, the piezoelectric vibrator corresponding to each pressure-generating chamber can be driven by providing at least an upper electrode in each pressure-generating chamber while the piezoelectric material layer is laid on the entire surface of the elastic film.

DETAILED DESCRIPTION

An inkjet recording head of an embodiment includes: an elastic film provided to form a part of a pressure-generating chamber connected to a nozzle opening; and a piezoelectric film-laminated part, an end thereof being fixed to the elastic film, a central part thereof facing the elastic film through an air gap, the piezoelectric film-laminated part including a laminate of a lower electrode, a piezoelectric film, and an upper electrode.

A certain amount of tensile residual stress is unavoidably generated in the piezoelectric film and upper and lower electrode films formed in a piezoelectric vibrator that uses the aforementioned thin film. Due to this tensile residual stress, there is a problem that a displacement amount of the elastic film would be reduced.

Further, when aluminum nitride (AlN) or zinc oxide (ZnO) not containing lead is used as the piezoelectric film instead of the piezoelectric film of lead zirconate titanate (PZT) that has been used, there is likewise the problem that the displacement amount of the elastic film would be reduced, since a piezoelectric coefficient would be smaller by one order of magnitude or more.

Embodiments herein will be described below with reference to the drawings.

(First Embodiment)

An inkjet recording head of the present embodiment includes: an elastic film provided to form a part of a pressure-generating chamber connected to a nozzle opening; and a piezoelectric film-laminated part, an end thereof being fixed to the elastic film, a central part thereof facing the elastic film through an air gap, the piezoelectric film-laminated part including a laminate of a lower electrode, a piezoelectric film, and an upper electrode.

By including the above structure, the elastic film can easily be subjected to buckling deformation, whereby the inkjet recording head with the improved displacement amount of the elastic film can be provided in the present embodiment. In particular, the displacement amount of the elastic film can be improved even when there exists residual stress in the piezoelectric film caused by film-forming process.

Figure 1:
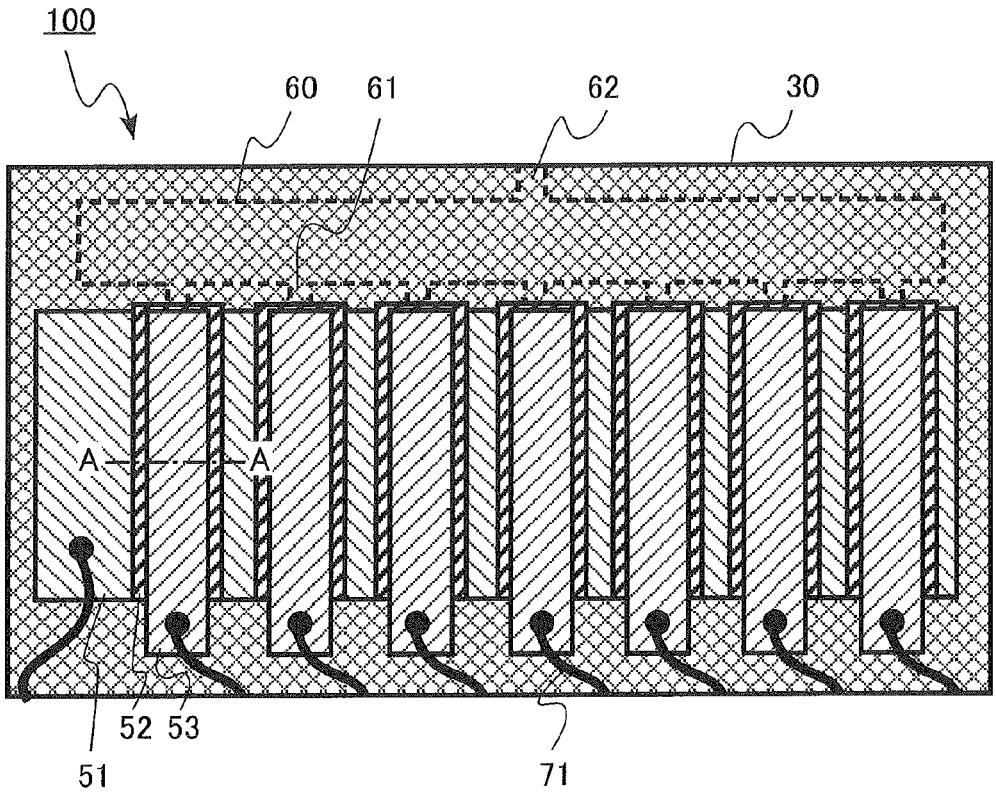
FIG. 1 is a top view of an inkjet recording head of a first embodiment.
Figure 2:
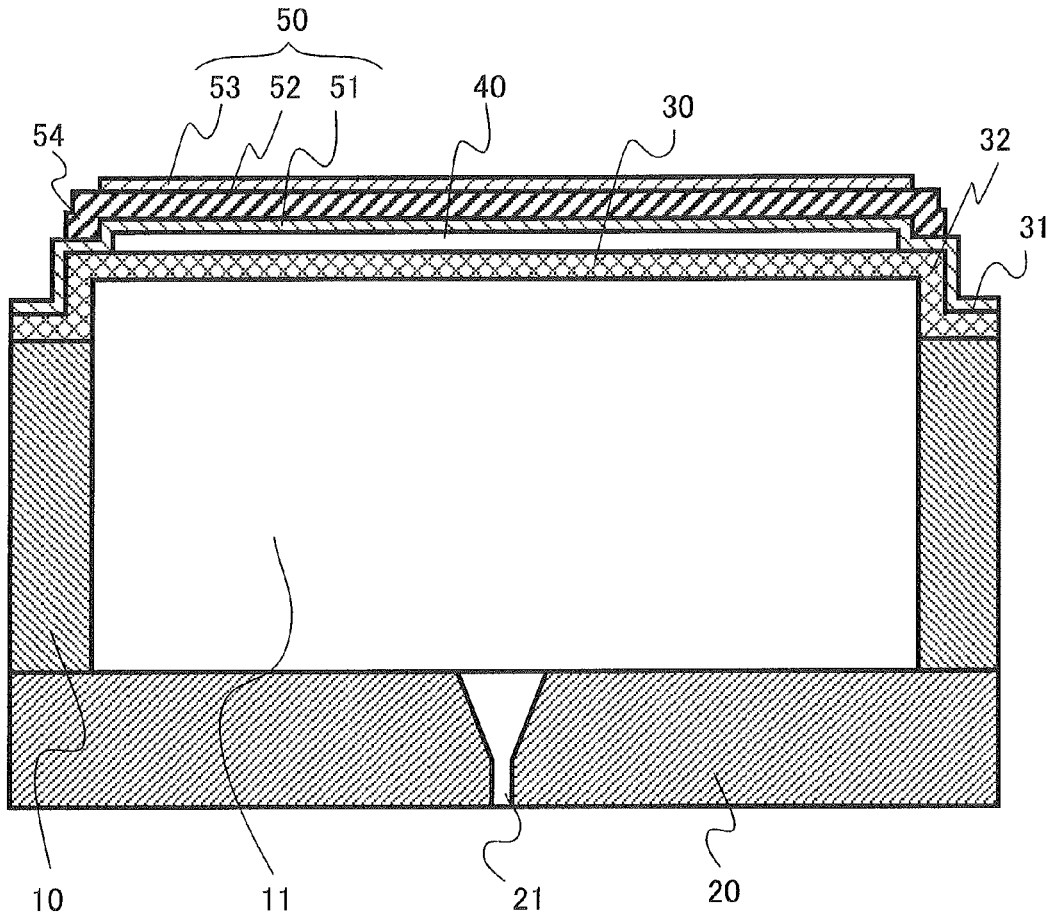
FIG. 2 is a cross-sectional view taken along line A-A in FIG. 1.

FIG. 1 is a top view showing the inkjet recording head of the present embodiment. The inkjet recording head shown in FIG. 1 is piezoelectrically driven. FIG. 2 is a cross-sectional view taken along line A-A of the inkjet recording head in FIG. 1. FIG. 2 is the view showing a cross-sectional structure of one of the plurality of pressure-generating chambers in a lateral direction.

An inkjet recording head 100 is formed by using a passage-forming substrate 10. A silicon substrate with a thickness of approximately 100 to 300 μm is used as the passage-forming substrate 10, for example, the thickness being preferably about 150 to 250 μm and more preferably about 200 μm. This is because the rigidity of a partition between the adjacent pressure-generating chambers can be maintained and the arrangement density can be increased.

One surface of the passage-forming substrate 10 is open, and an elastic film 30 with a thickness of approximately 1 to 2 μm is formed on the other surface thereof, the elastic film 30 being formed of a silicon oxide film (silicon dioxide), for example, that is thermally oxidized in advance. The elastic film 30 is provided to form a part of a pressure-generating chamber 11 connected to a nozzle opening 21. The elastic film 30 is a wall or a ceiling of the pressure-generating chamber 11.

The silicon oxide film is amorphous, which is preferable in terms of realizing a uniform deformation. This is also preferable in that a film having a stable composition and a stable characteristic can be manufactured easily. Furthermore, this is preferable in terms of having good consistency with a general process of manufacturing a semiconductor. From a similar point of view, it is also preferable to apply an amorphous silicon nitride film. Here, the elastic film 30 can be a film other than the silicon oxide film or the silicon nitride film above as long as the film has elasticity.

In addition, a step (a step structure) 32 is formed at the end of the elastic film 30. The step 32 is formed between a flat portion and fixed part with the passage-forming substrate 10 of the elastic film 30. This step 32 functions as a flexible region that deforms in a direction parallel to the surface of the elastic film 30. As a result, the displacement amount of the elastic film 30 can be increased when the residual stress is present in the piezoelectric film 52 or when a voltage is applied. The residual stress in the piezoelectric film 52 can also be alleviated.

On the other hand, a nozzle plate 20 formed of a silicon substrate is joined to the open surface of the passage-forming substrate 10 to form the pressure-generating chamber 11. The nozzle opening 21 is formed in the nozzle plate 20 by etching.

The size of the pressure-generating chamber 11 for applying pressure for ejecting ink droplets to the ink and the size of the nozzle opening 21 for ejecting the ink droplets are optimized in accordance with the amount of the ink droplets to be ejected, an ejection speed, and an ejection frequency. When recording 360 ink droplets per inch, for example, the nozzle opening 21 needs to be accurately formed with a groove width of several tens of micrometers.

Furthermore, each pressure-generating chamber 11 and a common ink chamber 60 are connected to each other through an ink supply path 61 each formed in a position of the nozzle plate 20 corresponding to one end of each pressure-generating chamber 11. Then, the ink is supplied from the common ink chamber 60 through this ink supply path 61 and distributed into each pressure-generating chamber 11.

On the other hand, a piezoelectric film-laminated part 50 is formed above the elastic film 30 on the opposite side from the open surface of the passage-forming substrate 10, the piezoelectric film-laminated part including a laminate of: a lower electrode 51 with a thickness of approximately 0.1 μm, for example; the piezoelectric film 52 with a thickness of approximately 0.3 μm, for example; and an upper electrode 53 with a thickness of approximately 0.1 μm, for example. For example, either one of the upper electrode 53 and the lower electrode 51 is used as a common electrode, and the other electrode and the piezoelectric film 52 are patterned for each pressure-generating chamber 11.

The piezoelectric film 52 is aluminum nitride (AlN), for example, and it is preferable that a full-width half-maximum (FWHM) of the orientation of a c-axis with respect to the surface of the piezoelectric film 52 be within two degrees, in terms of having excellent piezoelectric characteristics. The aluminum nitride, which does not contain lead, is superior in terms of being environmentally friendly. It is also superior in that a stable composition can be easily manufactured. Furthermore, the aluminum nitride is superior in terms of having good consistency with a semiconductor process. For the same reason as the aluminum nitride, zinc oxide (ZnO) is also a preferable material for the piezoelectric film 52.

Each of both ends 54 of the piezoelectric film-laminated part 50 is fixedly joined in the vicinity of the step 32 of the elastic film 30, and the rest is separated from the elastic film 30 through an air gap 40. At least the central part of the piezoelectric film-laminated part 50 faces the elastic film 30 through the air gap 40.

The inkjet recording head shown in FIGS. 1 and 2 takes in the ink from an ink inlet 62 connected to external ink supply means (not shown) and is filled with the ink throughout from the common ink chamber 60 to the nozzle opening 21.

Then, according to a recording signal from an external drive circuit (not shown), a voltage is applied between the lower electrode 51 and the upper electrode 53 through a lead electrode 71 so as to contract the piezoelectric film-laminated part 50 within the film surface. The elastic film 30 fixed to the both ends 54 of the piezoelectric film-laminated part 50 is subjected to the buckling deformation by the contracting force of the piezoelectric film-laminated part 50, whereby the pressure within the pressure-generating chamber 11 is increased and the ink droplets are ejected from the nozzle opening 21.

In the inkjet recording head of the present embodiment, the buckling deformation can easily be generated in the elastic film 30 by providing the air gap between the piezoelectric film-laminated part 50 and the elastic film 30 that are fixed together at the ends, when the film-forming residual stress exists in the piezoelectric film 52. As a result, the displacement amount of the elastic film 30 can be amplified or increased. Moreover, by providing the flexible region at the ends of the elastic film 30, the displacement amount of the elastic film 30 can be increased, and the residual stress in the piezoelectric film 52 can be alleviated. Therefore, the displacement amount of the elastic film 30 can be improved even when the film-forming residual stress exists in the piezoelectric film 52, thereby realizing the inkjet recording head with a high driving efficiency.

In addition, aluminum nitride (AlN) and zinc oxide (ZnO) not containing lead can be used as the piezoelectric film 52, thereby realizing the inkjet recording head that is also environmentally friendly. Moreover, these piezoelectric films 52 can be easily manufactured to have a stable composition and has good consistency with the semiconductor process, thereby allowing the inkjet recording head with stable characteristics to be manufactured at a low cost.

FIGS. 3A to 3E and 4A to 4D are views showing the method of manufacturing an inkjet recording head of the present embodiment. A process of forming the elastic film 30, the piezoelectric film 52 and the like on the passage-forming substrate 10 of a single-crystal silicon substrate will be described below with reference to FIGS. 3A to 3E and 4A to 4D.

Figure 3A:
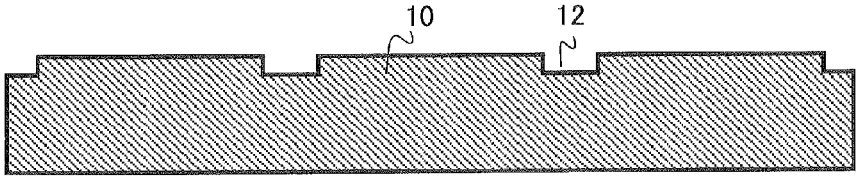
FIGS. 3A to 3E are views showing a method of manufacturing an inkjet recording head of the first embodiment.

First, as shown in FIG. 3A, a single-crystal silicon substrate wafer to be the passage-forming substrate 10 is patterned by photolithography and reactive ion etching to form a step 12.

Figure 3B:
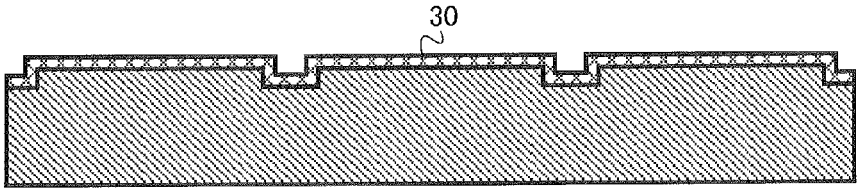

Then, as shown in FIG. 3B, the elastic film 30 formed of a silicon oxide film (silicon dioxide) is formed by performing thermal oxidation in a diffusion furnace at approximately 1100° C.

Figure 3C:
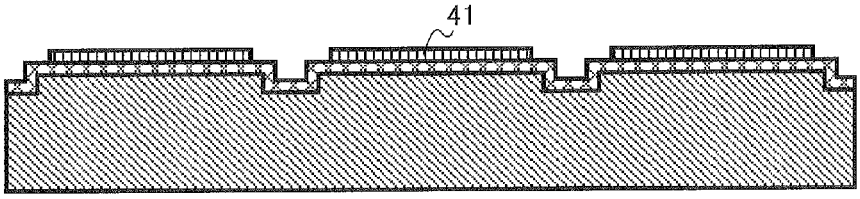

Then, as shown in FIG. 3C, a sacrificial layer 41 of an amorphous silicon film is formed on the elastic film 30 by sputtering and patterned by photolithography and reactive ion etching.

Figure 3D:
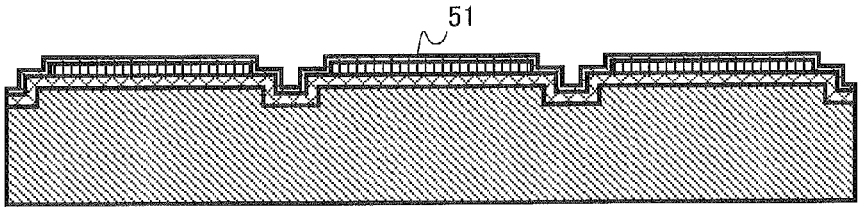

Then, as shown in FIG. 3D, the lower electrode 51 formed of titanium and gold films, for example, is formed on the sacrificial layer 41 and the elastic film 30 by sputtering and patterned by photolithography and reactive ion etching. Here, a lift-off method can be applied in the process instead of reactive ion etching.

Figure 3E:
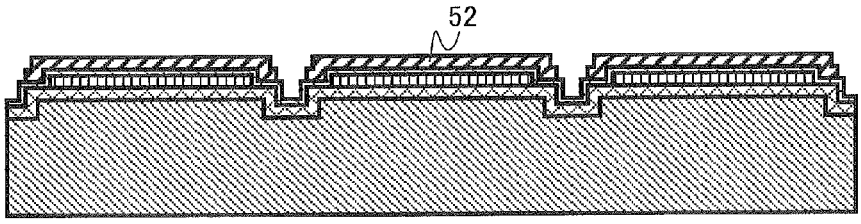

Then, as shown in FIG. 3E, the piezoelectric film 52 formed of aluminum nitride, for example, is formed by reactive sputtering and patterned by photolithography and reactive ion etching. Residual stress of some sort will be generated when film-forming aluminum nitride by reactive sputtering.

In the present embodiment, tensile film-forming residual stress is preferred in order to drive the elastic film 30 in a preferable manner and, in particular, the residual stress of approximately 100 to 200 MPa is preferred. The strength of the film-forming residual stress can be adjusted by a film-forming pressure at the time of sputtering, discharge power, and the like.

Figure 4A:
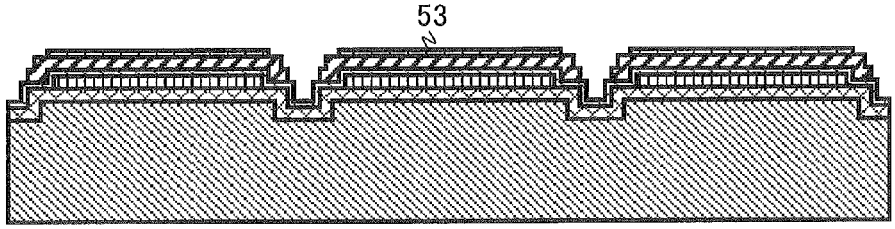
FIGS. 4A to 4D are views showing the method of manufacturing an inkjet recording head of the first embodiment.

Then, as shown in FIG. 4A, the upper electrode 53 of an aluminum film, for example, is formed on the piezoelectric film 52 by sputtering. The upper electrode 53 is thereafter patterned by photolithography and reactive ion etching.

Figure 4B:
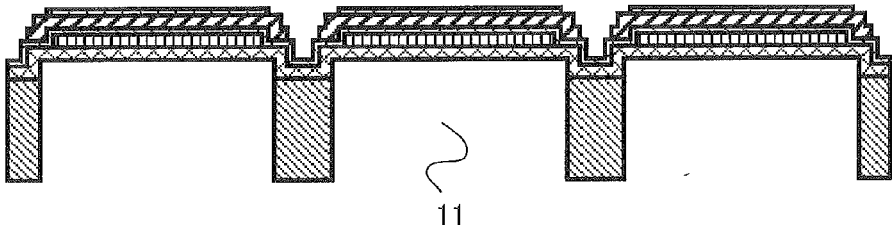

Then, as shown in FIG. 4B, the pressure-generating chamber 11 is patterned and formed by back-surface photolithography and reactive ion etching from the back surface side of the passage-forming substrate 10 facing the elastic film 30.

Figure 4C:
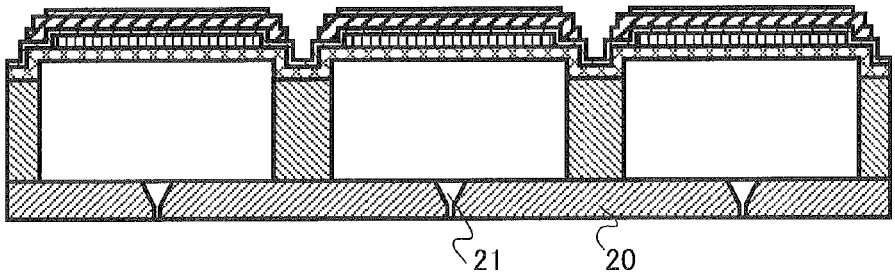

Then, as shown in FIG. 4C, the passage-forming substrate 10 and the nozzle plate 20 of a single-crystal silicon substrate are adhered together, the nozzle plate 20 being provided with the nozzle opening 21 in advance by photolithography and reactive ion etching. The adhesion may be performed by using a silicon direct bonding method, in which the both substrate surfaces are washed, brought into close contact with each other and adhered by pressurization in a vacuum atmosphere, or by using an adhesive such as an organic adhesive.

Figure 4D:
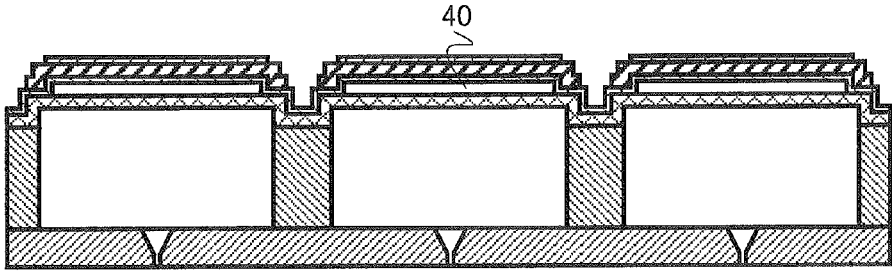

Then, the lower electrode 51, the piezoelectric film 52, and the upper electrode 53 are collectively patterned by photolithography and reactive ion etching to form an etching hole for the sacrificial layer (not shown). Then, as shown in FIG. 4D, the sacrificial layer 41 is removed via the etching hole for the sacrificial layer by means of dry etching using $XeF_2$ as an etchant, thereby forming the air gap 40.

In the series of film-formation and etching described above, a number of chips are simultaneously formed on a single wafer, and the wafer is divided thereafter into single chips as shown in FIG. 1.

The inkjet recording head of the present embodiment can be manufactured by the manufacturing method above.

(Second Embodiment)

The inkjet recording head of the present embodiment has a step structure of the elastic film different from that of the first embodiment. The present embodiment is similar to the first embodiment except for the step structure, and thus the contents overlapping the first embodiment will be omitted.

Figure 5:
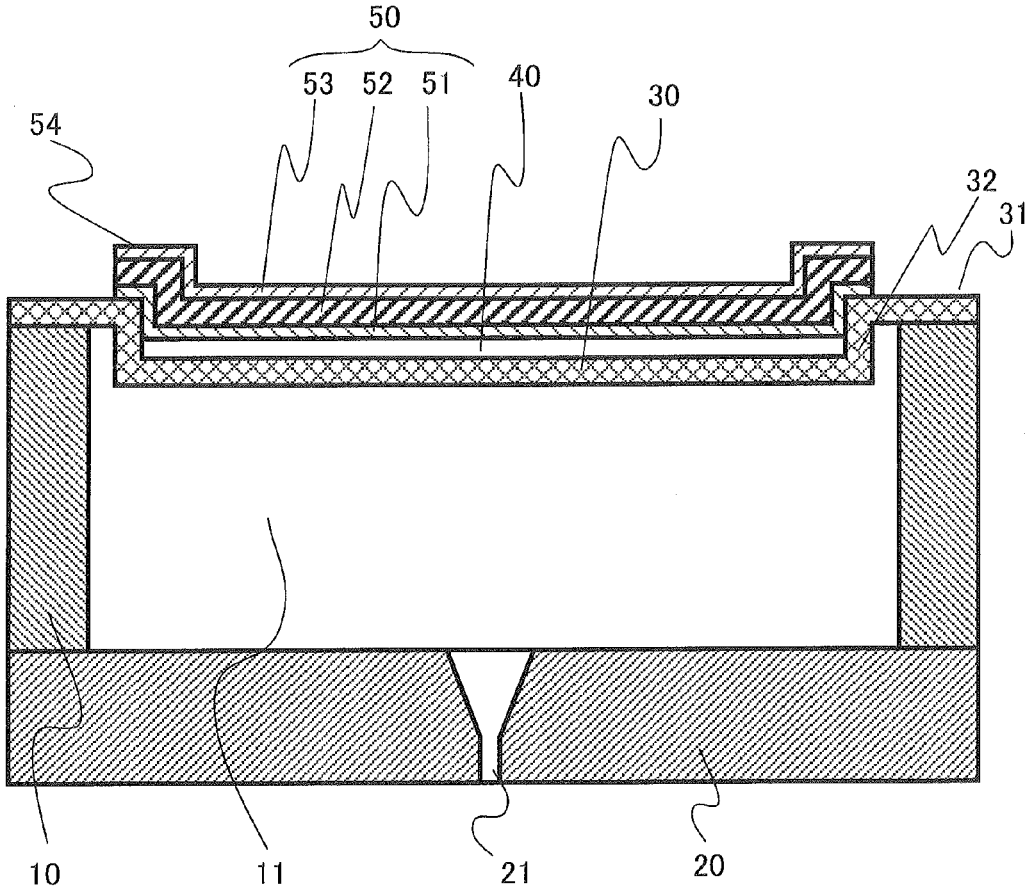
FIG. 5 is a cross-sectional view of an inkjet recording head of a second embodiment.
Figures 6A, 6B, 6C, 6D, 6E, 6F, 6G:
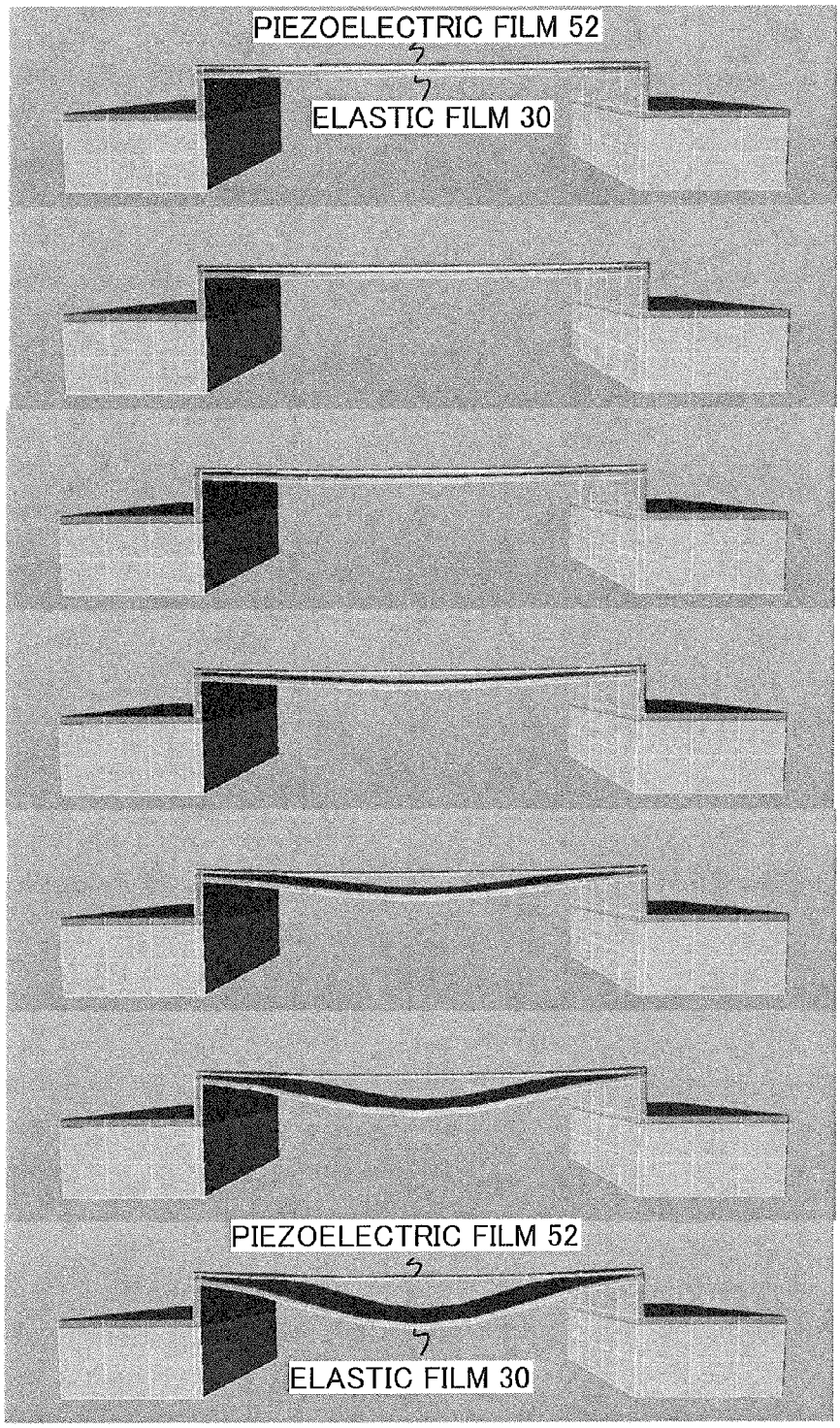
FIGS. 6A to 6G are schematic views showing the deformation behavior of a piezoelectric film and an elastic film of Example.

FIG. 5 is a cross-sectional view of the inkjet recording head of the present embodiment, showing the cross-sectional structure of a plurality of pressure-generating chambers 11 in a lateral direction. The same reference numerals are assigned to the components identical to those of the first embodiment.

In the present embodiment, an elastic film 30 includes a step 32 formed in a direction approaching the pressure-generating chamber 11 in the vicinity of a fixed part 31 with a passage-forming substrate 10. The step 32 is fixed to both ends 54 of a piezoelectric film-laminated part 50 including a lower electrode 51, a piezoelectric film 52, and an upper electrode 53.

When a tensile residual stress is present in the piezoelectric film 52, the piezoelectric film 52 contracts within the film surface, the elastic film 30 receives a compressive stress by the tensile stress, and a flexural deformation is generated on the pressure-generating chamber side by buckling. When a drive voltage is further applied between the upper and lower electrodes 53 and 51, the flexure in the elastic film 30 increases to act upon the ejection of the ink.

Such action and the improved driving efficiency effect are similar to those of the first embodiment. In addition, according to the present embodiment, there is an advantage that an ink head can be made thin and compact.

In the embodiment, the flexible region provided at the ends of the elastic film has been described with the step structure of the elastic film as an example. However, other structures can be applied as the flexible region, such as an arch structure of the elastic film and an elastic member or the like of an elastic spring structure or the like separate from the elastic film, so long as the structure has the function of deforming in the direction parallel to the surface of the elastic film.

Also, as shown in FIGS. 1, 2, and 5, the piezoelectric film 52 is individually provided in each pressure-generating chamber 11 to form the piezoelectric film-laminated part 50 in the embodiment; however, that is not the only form, and the piezoelectric film 52 may be provided over the entire surface, and the upper electrode 53 maybe individually provided in each pressure-generating chamber 11, for example. Moreover, in the present embodiment, the lower electrode 51 is evenly formed on the elastic film 30; however, that is not the only form, and the lower electrode 51 on both sides of the piezoelectric film-laminated part 50 in a width direction may be removed, for example.

Furthermore, for example, other semiconductor single-crystal substrates or the like may be applied as the passage-forming substrate 10 other than the single-crystal silicon substrate.

EXAMPLE

Example and Comparative Examples will be described below.

Example

A relationship between the stress applied to the piezoelectric film 52 and the flexure generated in the elastic film 30 will be described in more detail based on a simulation result. A simulation was performed with the inkjet recording head including the same structure as that of the first embodiment shown in FIGS. 1 and 2. Dimensions of principal parts of the inkjet recording head used in the simulation are shown in Table 1. Aluminum nitride (AlN) with an excellent c-axis orientation was used for the piezoelectric film 52. Also, platinum (Pt) was used for the upper electrode 53 and the lower electrode 51, and silicon oxide ($SiO_2$) was used for the elastic film 30.

TABLE 1

| | |
|---|---|
| PRESSURE-GENERATING CHAMBER WIDTH | 90 μm |
| ELASTIC FILM STEP HEIGHT | 5 μm |
| ELASTIC FILM THICKNESS | 1 μm |
| AIR GAP WIDTH | 0.5 μm |
| PIEZOELECTRIC FILM THICKNESS | 0.3 μm |
| UPPER ELECTRODE THICKNESS | 0.05 μm |
| LOWER ELECTRODE THICKNESS | 0.05 μm |

Figure 7:
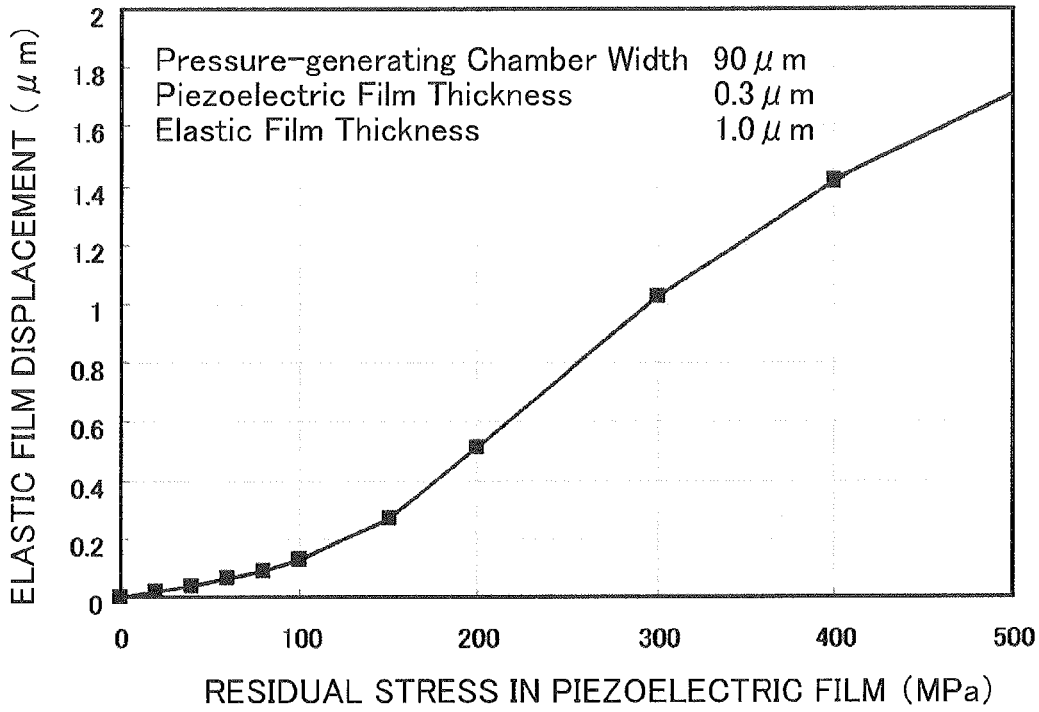
FIG. 7 is a graph showing a relationship between a residual stress of the piezoelectric film and a displacement amount of the elastic film of Example.

FIGS. 6A to 6G are schematic views showing the deformation behavior of the piezoelectric film 52 and the elastic film 30 when the residual stress of 0 MPa to 300 MPa was sequentially applied to the piezoelectric film 52 for every 50 MPa. FIG. 7 is a graph showing the displacement amount of the central part of the elastic film 30 in a direction perpendicular to the film surface, when the residual stress was similarly applied to the piezoelectric film 52. Here, the residual stress is the tensile stress.

As is apparent from FIGS. 6A to 6G and 7, the flexure generated in the elastic film 30 when the stress of approximately 100 MPa or less is applied to the piezoelectric film 52 is relatively small. However, the flexure drastically increases with the stress of 100 MPa or greater and gradually decreases again with the stress of 300 MPa or greater. This is due to the nonlinear buckling deformation generated in the elastic film.

Such stress applied to the piezoelectric film 52 is also generated by an electrostrictive effect generated in the piezoelectric film 52 when the drive voltage is applied between the upper and lower electrodes 53 and 51, other than the residual stress generated by film-formation. In the present Example, the stress of approximately 75 MPa is generated in the piezoelectric film 52 by applying the drive voltage of 30 V.

Figure 8:
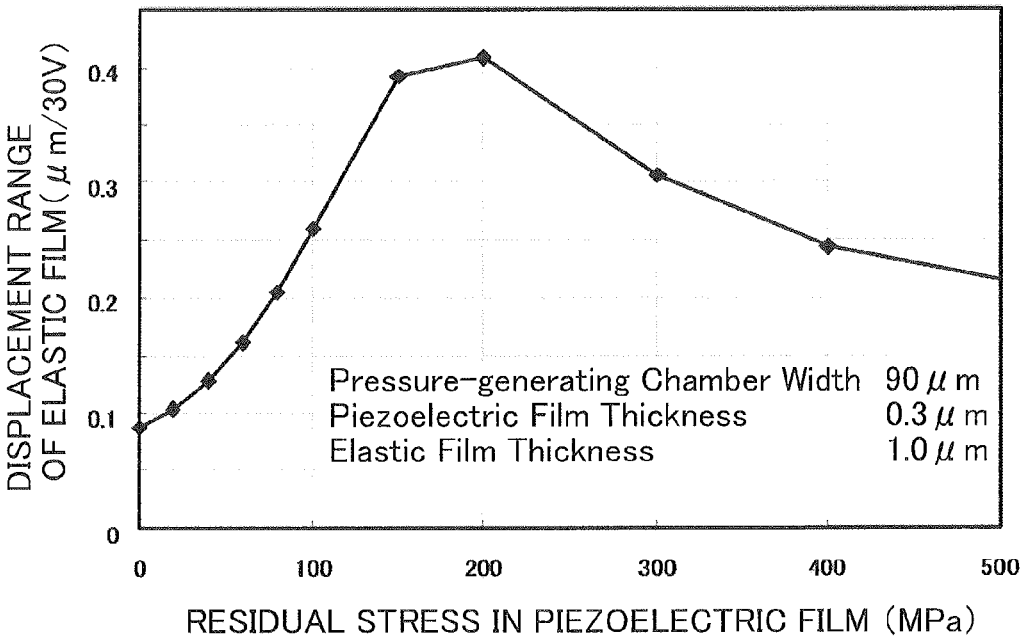
FIG. 8 is a graph showing a relationship between the residual stress of the piezoelectric film and a displacement range of the elastic film of Example.

FIG. 8 is a graph showing the displacement range of the elastic film 30 when the drive voltage of 30 V is further applied between the upper and lower electrodes 53 and 51, in addition to the film-forming residual stress of 0 to 500 MPa present in the piezoelectric film 52. The displacement range is an increment of displacement of the elastic film 30 before and after applying the drive voltage of 30 V.

The displacement range of the elastic film is at a local maximum of approximately 0.4 μm/30 V when the residual stress in the piezoelectric film 52 is approximately 150 to 200 MPa. This residual stress corresponds to an inflection point of a displacement curve of the elastic film shown in FIG. 6.

The displacement range of the elastic film increases by a factor of four or more when the residual stress is approximately 200 MPa, since the displacement range of the elastic film when the residual stress is 0 is 0.1 μm/30 V or less. Such a unique nonlinear effect accompanies the aforementioned buckling deformation of the elastic film. This buckling deformation is generated by the air gap 40 being provided and accelerated by the step 32 provided.

Now, in the present Example, the behavior of the elastic film when varying each parameter in Table 1 will be examined in detail by using the simulation result in the similar manner.

Figure 9:
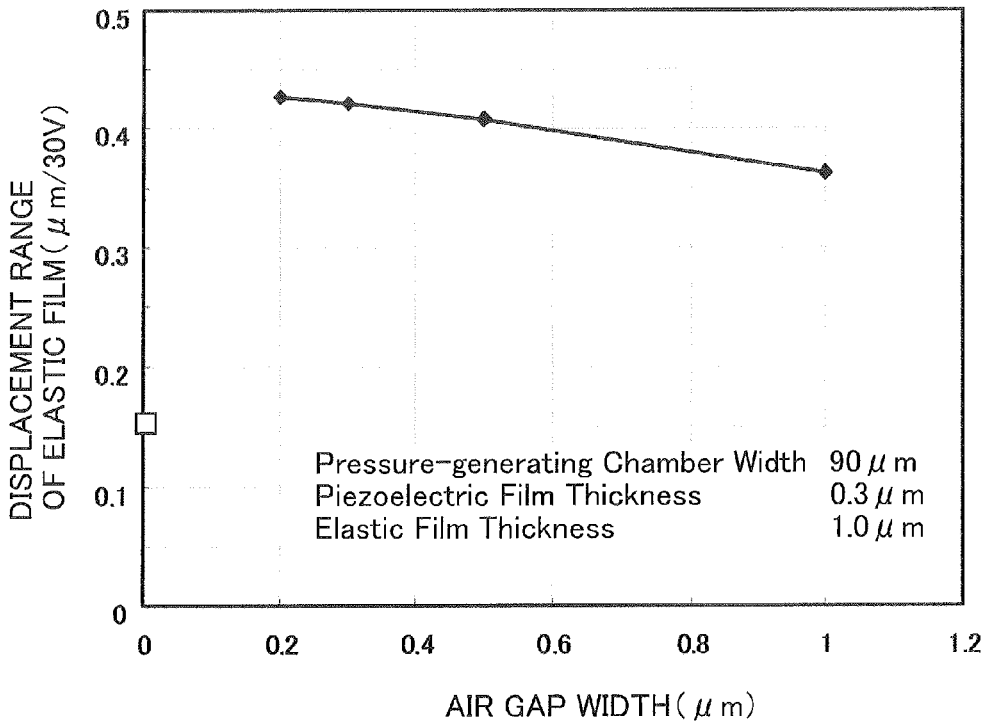
FIG. 9 is a graph showing a relationship between an air gap width and the displacement range of the elastic film of Example.

FIG. 9 is a graph showing the displacement range of the elastic film when the width of the air gap 40 between the piezoelectric film 52 and the elastic film 30 is varied from 0.2 μm to 1 μm. The residual stress in the piezoelectric film 52 was set to 200 MPa in all cases. The smaller the air gap width, the more gradually the displacement range of the elastic film tends to increase. From this point of view, therefore, the smaller the air gap, the better. When there is no air gap (indicated with a white square in FIG. 9), the displacement range would be drastically decreased since no buckling deformation would be generated.

When the width of the air gap 40 is too small, the elastic film 30 and the piezoelectric film 52 may be stuck together during the process of removing the sacrificial layer. For this reason, the width of the air gap is preferably about 0.05 to 0.5 μm.

Figure 10:
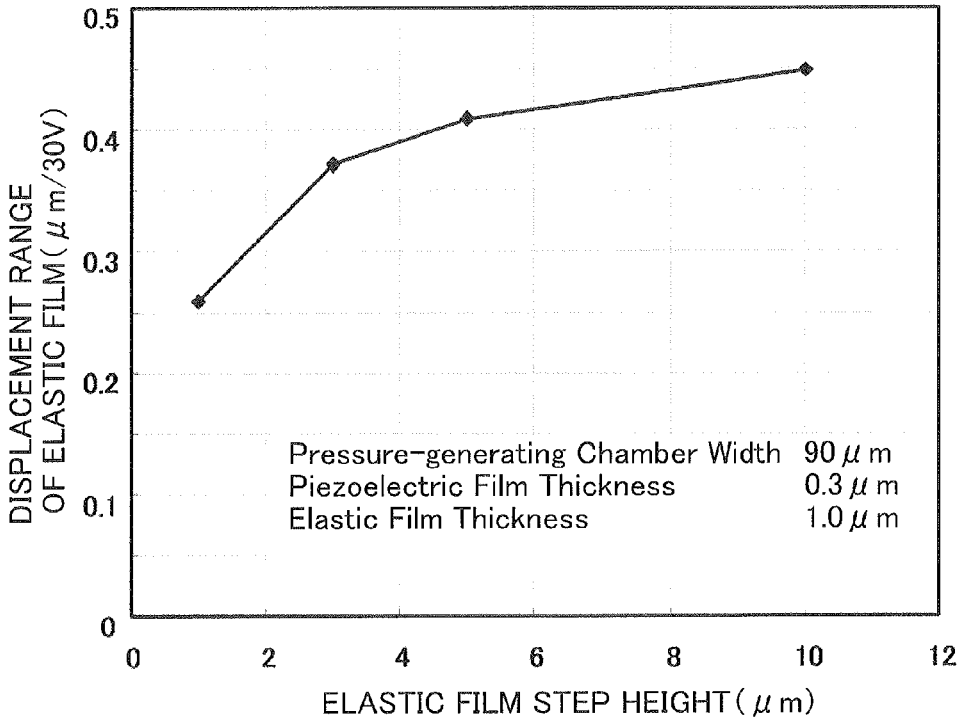
FIG. 10 is a graph showing a relationship between a step height and the displacement range of the elastic film of Example.

FIG. 10 is a graph showing the displacement range of the elastic film when the height of the step 32 formed at the ends of the elastic film 30 is varied from 1 μm to 10 μm. The residual stress in the piezoelectric film 52 was set to 200 MPa in all cases. The greater the height of the step 32, the more the displacement range of the elastic film tends to increase but is gradually saturated. Therefore, the greater the step 32, the better. When the step 32 is too large, exposure at the time of lithography or uniform application of a resist film would be difficult. For this reason, the height of the step 32 is preferably about 2 to 10 μm.

Figure 11:
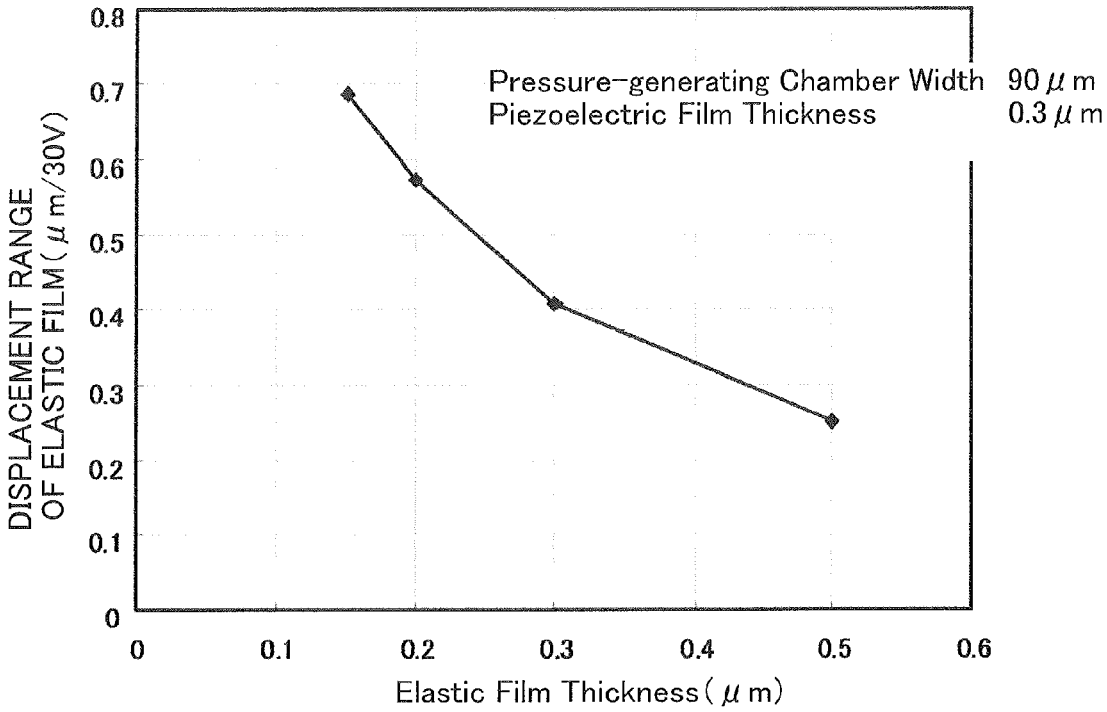
FIG. 11 is a graph showing a relationship between a thickness of the piezoelectric film and the displacement range of the elastic film of Example.

FIG. 11 is a graph showing the displacement range of the elastic film when the thickness of the piezoelectric film 52 is varied from 0.15 μm to 0.5 μm. The residual stress in the piezoelectric film 52 was set to 200 MPa in all cases. The thinner the piezoelectric film 52, the more the displacement range of the elastic film tends to increase; therefore, the thinner the piezoelectric film 52, the better. However, the piezoelectric film 52 needs to be thick enough to avoid a dielectric breakdown when the drive voltage (30 V in this case) is applied, since there is a limit for a dielectric breakdown voltage in the piezoelectric film 52. Thus, the thickness of the piezoelectric film is preferably about 0.05 to 0.3 μm when using aluminum nitride that is formed into a film by reactive sputtering and sufficiently oriented to the c-axis.

Figure 12:
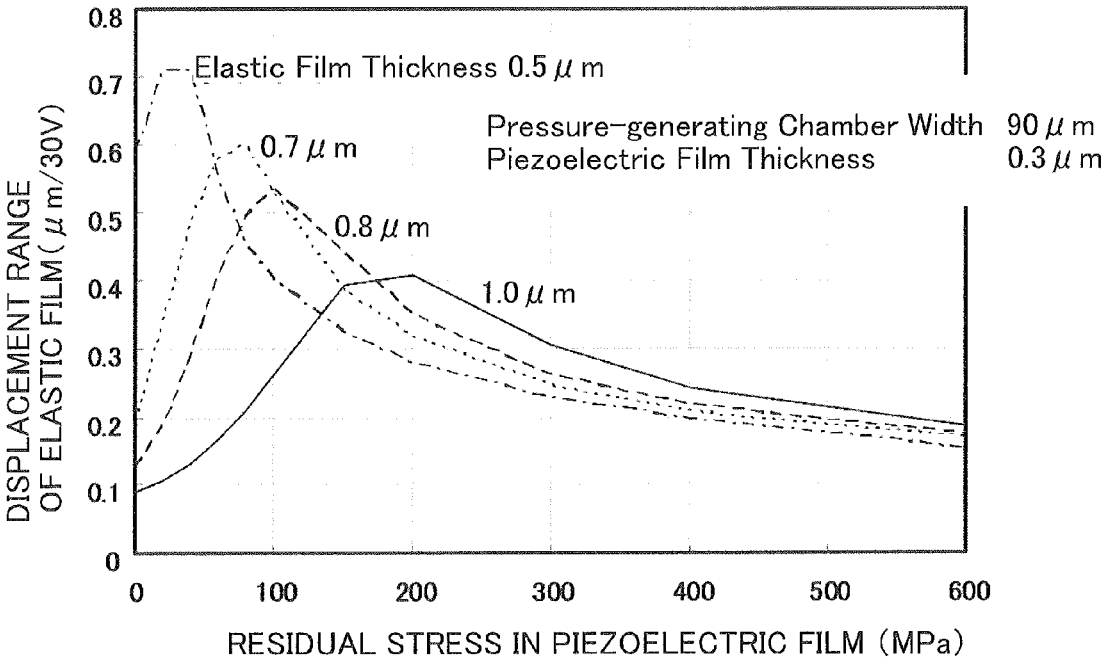
FIG. 12 is a graph showing a relationship between a thickness of the elastic film and the displacement range of the elastic film of Example.

FIG. 12 is a graph showing the displacement range of the elastic film as a function of the residual stress in the piezoelectric film 52 when the thickness of the elastic film 30 is varied from 0.5 μm to 1.0 μm. For each elastic film thickness, there is a certain amount of residual stress that causes a peak displacement range in the elastic film, the residual stress being about 30 MPa, 70 MPa, 100 MPa, and 200 MPa for the elastic film thickness of 0.5 μm, 0.7 μm, 0.8 μm, and 1.0 μm, respectively.

It is therefore preferred to grasp the film-forming residual stress generated in the piezoelectric film 52 and determine the optimal thickness of the elastic film 30 such that the displacement range of the elastic film would increase according to the film-forming residual stress. In general, the thickness of the elastic film is about 0.5 to 1.5 μm.

Comparative Example 1

Now, as Comparative Example 1, the simulation result of the inkjet recording head including a unimorph structure of the related art has been shown in the similar manner and compared with Example in detail.

Figure 13:
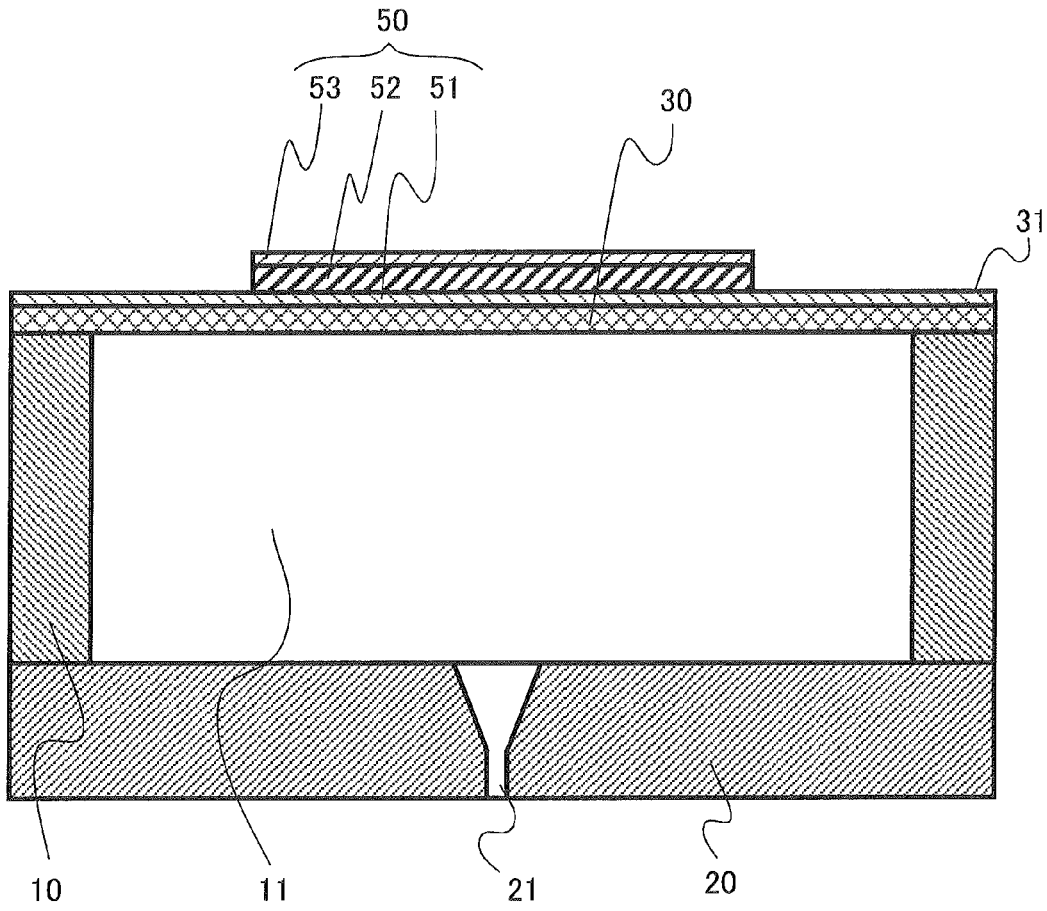
FIG. 13 is a cross-sectional view of an inkjet recording head of Comparative Example 1.

FIG. 13 is a view showing a cross-sectional structure of one pressure-generating chamber of Comparative Example 1 in the lateral direction. The same reference numerals are assigned to the components identical to those of Example. In Comparative Example 1, the elastic film 30 is flat, and the central part thereof is provided with a piezoelectric film-laminated part 50 including a flat lower electrode 51, piezoelectric film 52, and upper electrode 53 and being directly laminated on the elastic film 30, thereby forming what is called a piezoelectric unimorph structure.

In the present Comparative Example, the width of the piezoelectric film-laminated structure is set to two-thirds of the internal width of the pressure-generating chamber, since the maximum driving efficiency can be achieved when the width is set to be approximately 60 to 70% of the internal width of the pressure-generating chamber. The other forms, dimensions and materials are the same as those of Example. Dimensions of principal parts of the present Comparative Example used in the simulation are shown in Table 2.

TABLE 2

| | |
|---|---|
| PRESSURE-GENERATING CHAMBER WIDTH | 90 μm |
| ELASTIC FILM THICKNESS | 1 μm |
| PIEZOELECTRIC FILM WIDTH | 60 μm |
| PIEZOELECTRIC FILM THICKNESS | 0.3 μm |
| UPPER ELECTRODE THICKNESS | 0.05 μm |
| LOWER ELECTRODE THICKNESS | 0.05 μm |

Figure 14:
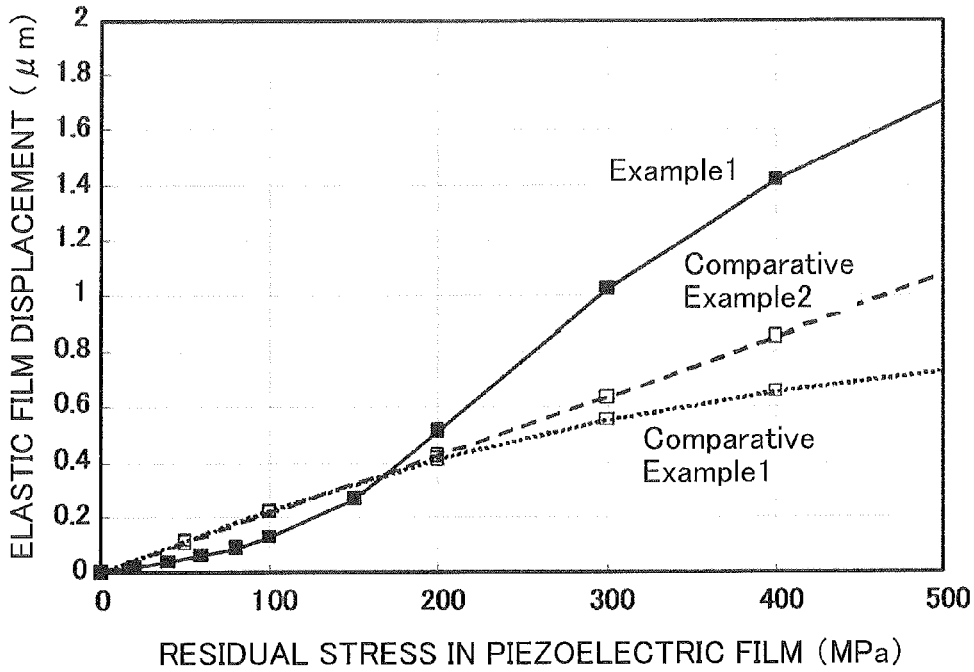
FIG. 14 is a graph showing a relationship between the residual stress of the piezoelectric film and the displacement amount of the elastic film of Example and Comparative Examples.

FIG. 14 is a graph showing the displacement amount of the elastic film 30 in a direction perpendicular to the film surfaces of the piezoelectric film 52 and the elastic film 30, when the residual stress is applied to the piezoelectric film 52. Although flexural deformation is generated by the difference in the stress applied to the piezoelectric film 52 and the elastic film 30, the displacement curve has a convex shape as shown in FIG. 14 since the flexural deformation would be restricted as the tensile stress is increased.

Figure 15:
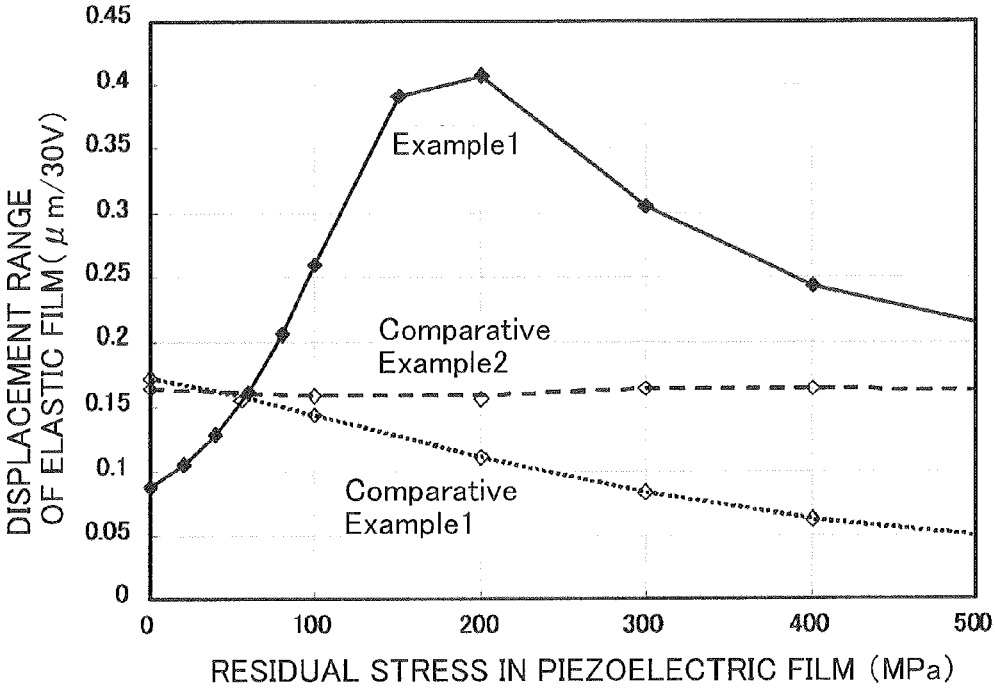
FIG. 15 is a graph showing a relationship between the residual stress of the piezoelectric film and the displacement range of the elastic film of Example and Comparative Examples.

FIG. 15 is a graph showing the displacement range of the elastic film 30 when the drive voltage of 30 V is applied between the upper and lower electrodes 53 and 51, in addition to the film-forming residual stress of 0 to 500 MPa present in the piezoelectric film 52. The displacement range of the elastic film when there is no residual stress is approximately 0.17 μm, which would be gradually decreased as the residual stress is increased, since the flexure would be restricted as described above. The displacement range would be decreased to approximately 0.05 μm at 500 MPa.

Comparing Example with Comparative Example 1, the displacement range of Example is greater than that of Comparative Example 1 by a factor of approximately four around the residual stress of 200 MPa at which Example has the peak displacement range. This manifests the superiority of Example.

Comparative Example 2

Figure 16:
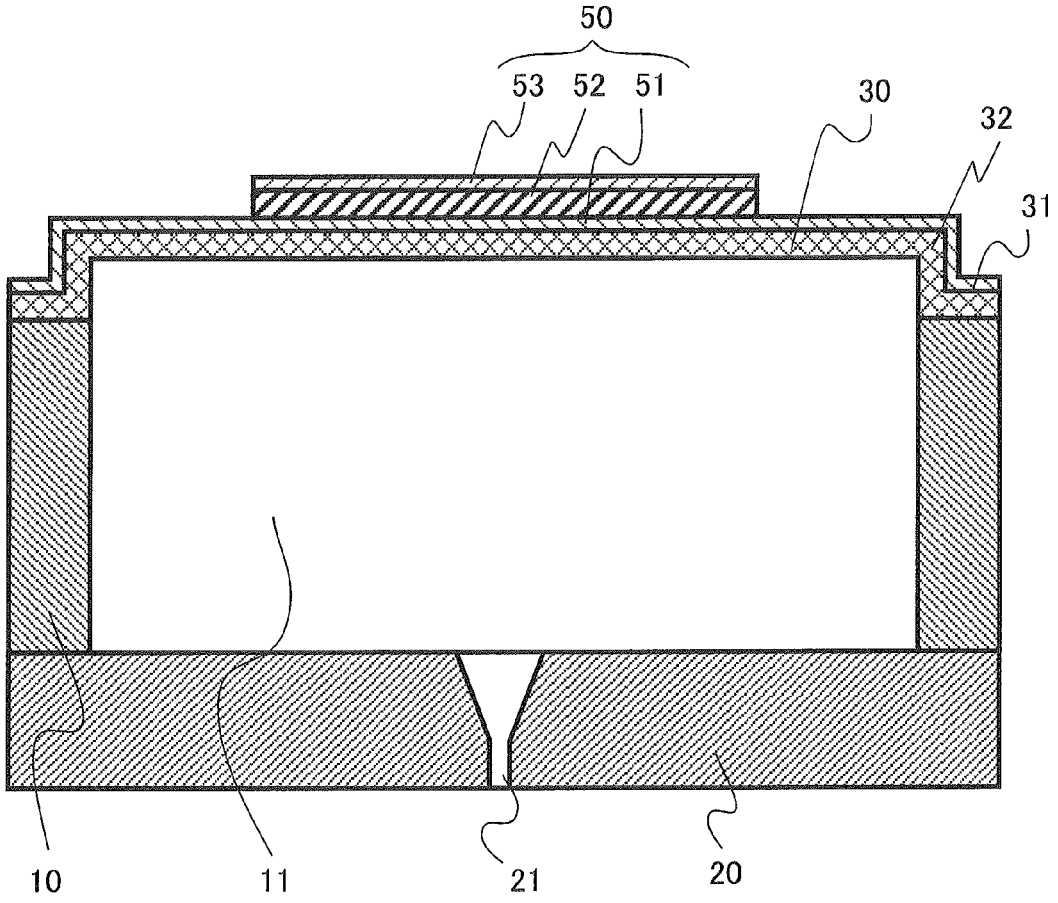
FIG. 16 is a cross-sectional view of an inkjet recording head of Comparative Example 2.

Now, as Comparative Example 2, the simulation result of the inkjet recording head including the elastic film with the step and the unimorph structure has been shown in the similar manner and compared with Example in detail. FIG. 16 is a view showing a cross-sectional structure of one pressure-generating chamber of Comparative Example 2 in the lateral direction. The same reference numerals are assigned to the components identical to those of Example.

In Comparative Example 2, the elastic film 30 has the step 32, which plays a role of alleviating the tensile stress component generated by the residual stress in the piezoelectric film. Here, the height of the step 32 is set to 5 μm. The central part of the elastic film 30 is provided with the piezoelectric film-laminated part 50 including the flat lower electrode 51, piezoelectric film 52, and upper electrode 53 and being directly laminated on the elastic film 30, thereby forming what is called the piezoelectric unimorph structure.

In the present Comparative Example, the width of the piezoelectric film-laminated structure is set to two-thirds of the internal width of the pressure-generating chamber, since the maximum driving efficiency can be achieved when the width is set to be approximately 60 to 70% of the internal width of the pressure-generating chamber. The other forms, dimensions and materials are the same as those of Example. Dimensions of principal parts of the present Comparative Example used in the simulation are shown in Table 3.

TABLE 3

| | |
|---|---|
| PRESSURE-GENERATING CHAMBER WIDTH | 90 μm |
| ELASTIC FILM STEP HEIGHT | 5 μm |
| ELASTIC FILM THICKNESS | 1 μm |
| PIEZOELECTRIC FILM WIDTH | 60 μm |
| PIEZOELECTRIC FILM THICKNESS | 0.3 μm |
| UPPER ELECTRODE THICKNESS | 0.05 μm |
| LOWER ELECTRODE THICKNESS | 0.05 μm |

The result of Comparative Example 2 is also shown in FIG. 14 that has already been shown. It can be understood that the flexural deformation is generated by the difference in the stress applied to the piezoelectric film 52 and the elastic film 30, and that the flexural deformation increases in proportion to the increase in the residual stress in a roughly linear manner.

FIG. 15 also shows the result of Comparative Example 2. The displacement range of the elastic film is about 0.17 μm regardless of the residual stress and is, in particular, far greater than that of Comparative Example 1 in a region where the residual stress is large, manifesting the effect of the step for alleviating the residual stress.

Comparing Example with Comparative Example 2, however, the displacement range of Example is greater than that of Comparative Example 2 by a factor of approximately three around the residual stress of 200 MPa at which Example has the peak displacement range. This manifests the superiority of Example.

While certain embodiments have been described, these embodiments have been presented by way of example only, and are not intended to limit the scope of the inventions. Indeed, the inkjet recording head described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

What is claimed is:

1. An inkjet recording head comprising:

an elastic film provided to form a part of a pressure-generating chamber, the pressure-generating chamber connected to a nozzle opening; and a piezoelectric film-laminated part, an end of the piezoelectric film-laminated part being fixed to the elastic film, an air gap being provided between a central part of the piezoelectric film-laminated part and the elastic film, the piezoelectric film-laminated part including a lower electrode, a piezoelectric film, and an upper electrode.

2. The inkjet recording head according to claim 1, further comprising, at an end of the elastic film, a flexible region that can be deformed in a direction parallel to a surface of the elastic film.

3. The inkjet recording head according to claim 2, wherein the flexible region is a step structure provided in the elastic film.

4. The inkjet recording head according to claim 1, wherein the piezoelectric film includes aluminum nitride.

5. The inkjet recording head according to claim 1, wherein the elastic film is a silicon nitride film or a silicon oxide film.

6. The inkjet recording head according to claim 3, wherein the step structure is a step formed in a direction in which the elastic film approaches towards inside of the pressure-generating chamber from the end.

7. The inkjet recording head according to claim 1, wherein the upper electrode and the lower electrode include platinum.

* * * * *